US005812683A

United States Patent [19]

Parker et al.

[11] Patent Number: 5,812,683

[45] Date of Patent: Sep. 22, 1998

[54] HEADPHONE JACK EXTENDED OUTLET

[76] Inventors: Thomas F. Parker, 18163 Holcumb Rd.; Thomas J. Nook, 13266 Greenleaf La., both of Grand Haven, Mich. 49417

[21] Appl. No.: 488,970

[22] Filed: Jun. 7, 1995

Related U.S. Application Data

[63] Continuation-in-part of Ser. No. 210,459, Mar. 21, 1994, abandoned.

[51] Int. Cl.[6] ..... H04R 1/10

[52] U.S. Cl. ..... 381/74; 381/183; 381/25; 439/638; 439/650

[58] Field of Search ..... 381/72, 26, 77, 381/78, 120, 25, 74, 28, 183, 187; 455/149; 439/502, 638–9, 650

[56] References Cited

U.S. PATENT DOCUMENTS

| | | | |
|---|---|---|---|
| 3,541,915 | 11/1970 | Rhodes | 381/77 |
| 3,586,977 | 6/1971 | Lustig et al. . | |
| 4,097,111 | 6/1978 | Martin | 439/638 |
| 4,324,951 | 4/1982 | Brown | 381/77 |
| 4,412,106 | 10/1983 | Pavel . | |
| 4,829,571 | 5/1989 | Kakiuchi et al. | 381/74 |
| 4,944,016 | 7/1990 | Christian | 381/74 |
| 5,201,003 | 4/1993 | Pavel . | |

OTHER PUBLICATIONS

"Radio Shack" (Catalog), 1988, pp. 44–45.

*Primary Examiner*—Curtis A. Kuntz
*Assistant Examiner*—Xu Mei
*Attorney, Agent, or Firm*—Price, Heneveld, Cooper, DeWitt & Litton

[57] ABSTRACT

A headphone jack extended outlet which amplifies and splits the output signal from a single conventional headphone jack to power multiple headphone jacks. The extended outlet includes a conventional headphone plug that inserts directly into the headphone jack of a sound system and includes multiple headphone jacks for powering multiple headsets. The extended outlet further includes circuitry which amplifies the output signal received from the sound system to a level sufficient to power multiple headsets.

13 Claims, 4 Drawing Sheets

HEADPHONE JACK EXTENDED OUTLET

CROSS-REFERENCE TO RELATED APPLICATION

This application is a continuation-in-part of application Ser. No. 08/210,459, filed Mar. 21, 1994, now abandoned.

BACKGROUND OF THE INVENTION

The present invention relates to audio electronics and more particularly to a headphone lack outlet.

Sound systems, including portable cassette and compact disc players, are almost universally provided with a headphone jack which allows an individual to listen to the sound system in isolation through a headset. Conventionally, output to the external speakers is terminated when a headset is plugged into the headphone jack. This allows an individual to listen to the sound system without interfering with others who would otherwise hear the output of the external speakers. The conventional system discussed above allows only a single listener to receive isolated output from the sound system.

Splitting adaptors have been developed that plug directly into the conventional headphone jack and in turn accommodate two headphone plugs. However, splitting adaptors increase the power draw through the headphone jack and dramatically decrease the life of the batteries powering the sound system. In addition, the sound quality of the system may suffer as a result of the increased power draw.

SUMMARY OF THE INVENTION

The aforementioned problems are overcome in the present invention including a headphone jack extended outlet which amplifies and splits the output signal from a single conventional headphone jack to power multiple headphone jacks.

The present invention plugs directly into the headphone jack of a conventional sound system and includes multiple headphone jacks for powering multiple headsets. The headphone jack extended outlet generally includes circuitry which amplifies the output signal of a single stereo headphone jack to a level sufficient to power multiple stereo headsets. Preferably, a dedicated amplifier is provided for each headset.

The present invention provides a simple and inexpensive means for adapting a conventional sound system to provide for isolated sound output to multiple listeners. The amplifying circuitry boosts the output signal to prevent excessive power draw through the sound system's headphone jack, thereby preserving the life of the batteries powering the sound system. In addition, the present invention may be powered by a battery to provide for portability and ease of use. And finally, the headphone jack extended outlet may be housed in a weather resistant housing to allow outdoor use, such as at the beach or park.

These and other objects, advantages and features of the present invention will be more fully understood and appreciated by reference to the detailed description of the preferred embodiment and the drawings.

DETAILED DESCRIPTION OF THE PREFERRED EMBODIMENTS

Figure 1:
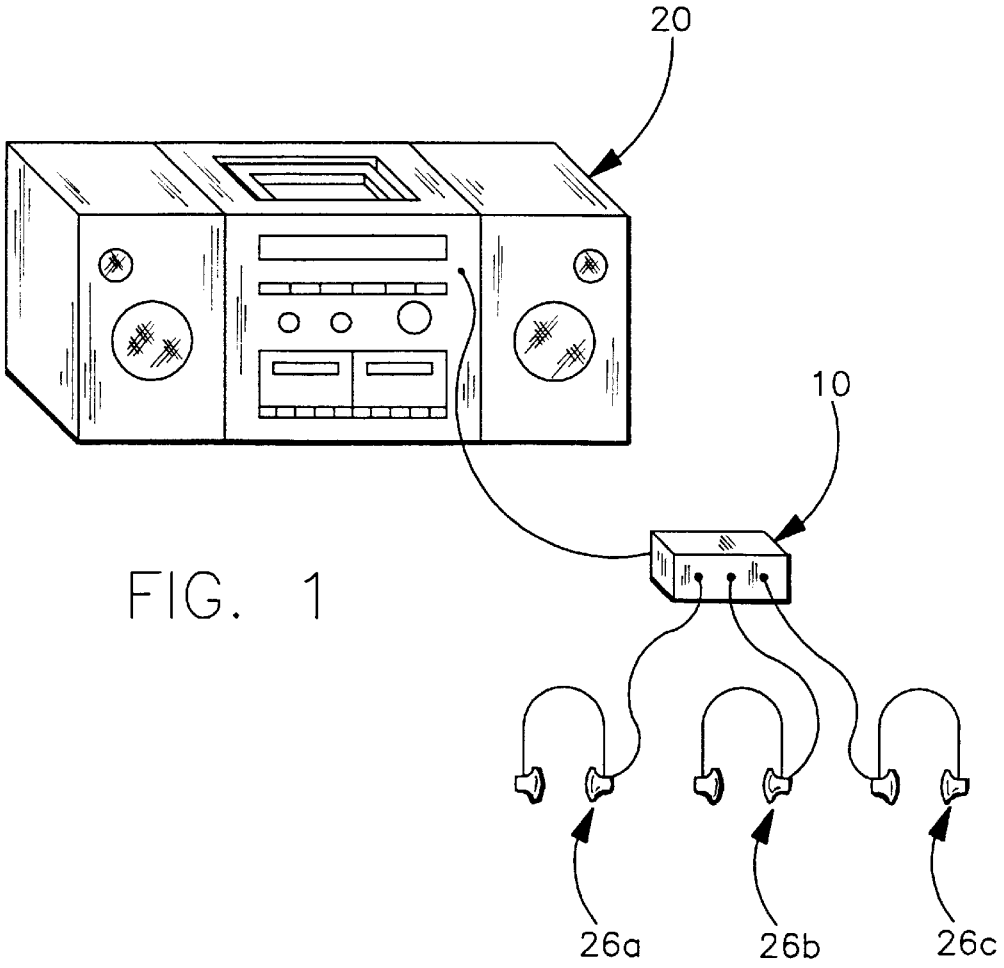
FIG. 1 is a perspective view of multiple headsets connected to a portable sound system via the present invention.

By way of disclosure, and not by way of limitation, a first embodiment of the headphone jack extended outlet 10 of the present invention is depicted in FIG. 1 in conjunction with a portable sound system 20 and a plurality of headsets or headphones 26*a–c*. Headsets a–c are connected to portable sound system 20 through extended outlet 10 which amplifies and splits the output signal of the sound system 20.

Figure 2:
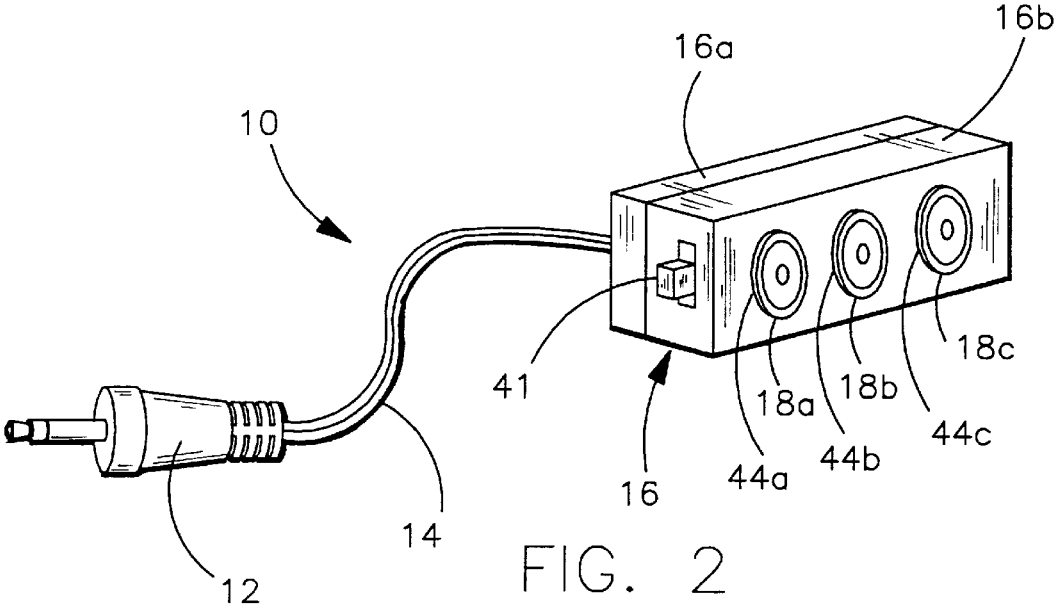
FIG. 2 is a perspective view of a first embodiment headphone jack extended outlet.

As perhaps best illustrated in FIG. 2, the headphone jack extended outlet 10 generally includes a headphone plug 12, cable 14, housing 16 and multiple headphone jacks 18*a–c*. The headphone plug 12 and headphone jacks 18*a–c* are conventional stereo connectors, and the manner of their incorporation into the present invention will be readily apparent to those of ordinary skill in the art.

The housing 16 is comprised of two halves 16*a* and 16*b* that are sandwiched together to enclose the circuitry 20 and power source 40 for outlet 10. The first half 16*a* of the housing 14 includes an opening (not shown) through which cable 14 passes. The second half 16*b* of the housing includes three openings 44*a–c* for mounting headphone jacks 18*a–c*. The housing 16 may be constructed with conventional weather-resistant hardware, such as seals, grommets and plugs. This will allow the outlet 10 to be used in an outdoor setting.

Figure 3:
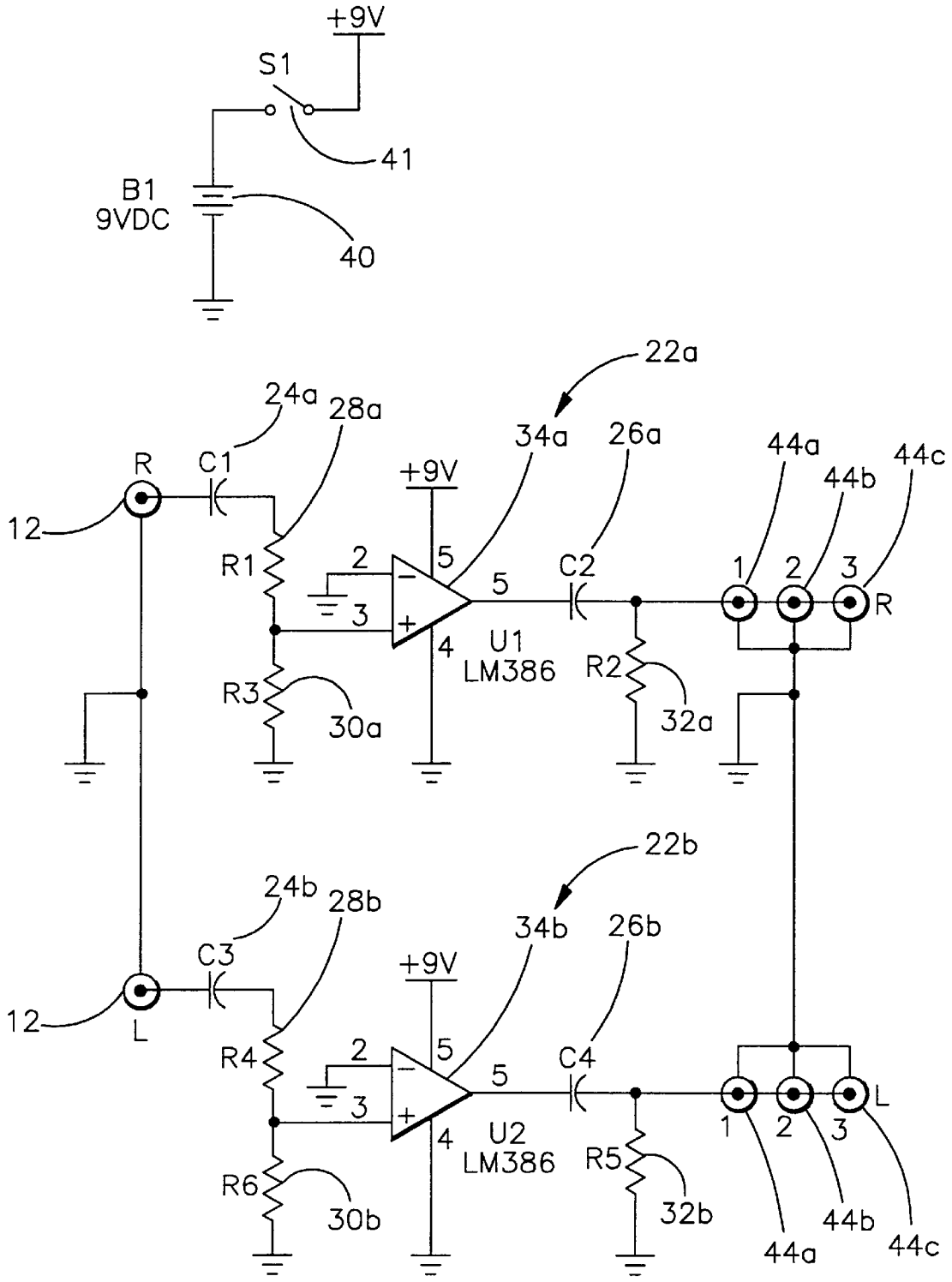
FIG. 3 is a schematic diagram of a first embodiment of the circuitry for practicing this invention.

Referring now to FIG. 3, a first embodiment of the circuitry 20 of outlet 10 is designed to receive signals through a conventional headphone plug, amplify the signals and apply the amplified signals to multiple headphone jacks. The circuitry 20 receives separate left and right channel signals through the left and right channel contacts of plug 12. The left and right channel signals are passed separately through cable 14 to the elements of the circuit 20.

The circuit 20 generally includes two identical branches 22*a* and 22*b* that separately boost and split the left and right channel signals. Each of the two branches 22*a* and 22*b* comprise distinct, but identical, amplifying and splitting circuitry. In a preferred embodiment, capacitors 24*a*, 24*b*, 26*a* and 26*b* have a capacitance of 220 mircrofarads. Resistors 28*a* and 28*b* have a resistance of 15 kilohms and resistors 30*a*, 30*b*, 32*a* and 32*b* have a resistance of 10 kilohms.

The left and right channel signals are preferably amplified by linear integrated circuits (ICs) 34*a* and 34*b*. ICs 34*a–b* are conventional operational amplifiers (op amps), such as the LM386n-1. The ICs 34*a–b* receive a signal through the headphone plug 12 and amplify the signal to provide sufficient power to drive multiple headsets. The outlet 10 also includes a power source 40 for powering op amps 34*a* and 34*b*. A power switch 41 is provided to turn on and off the outlet 10. In a preferred embodiment, the power source 40 is a conventional 9-volt battery. Alternatively, the outlet 10 can be powered by a conventional power supply that converts 120-volt alternating current to 9-volt direct current.

Figure 4:
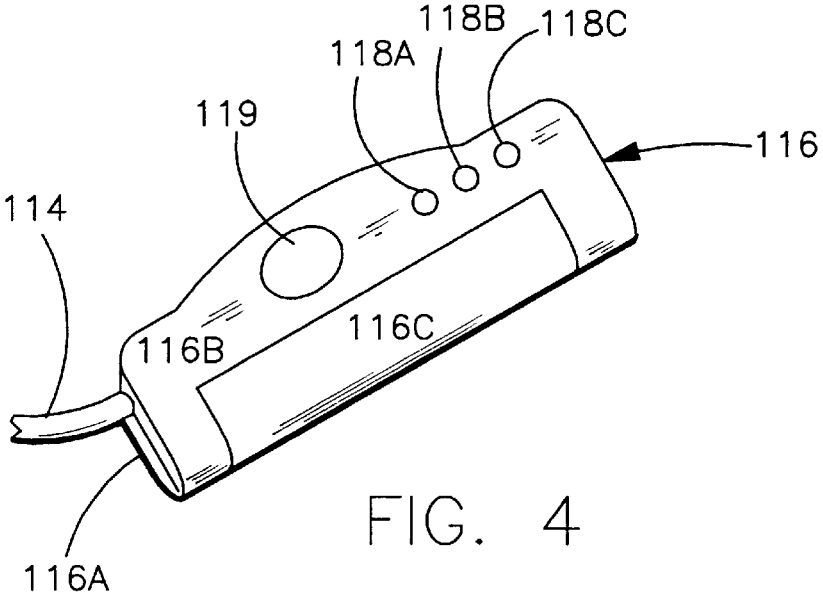
FIG. 4 is an exploded perspective view of a second, and more preferred, embodiment of the headphone jack extended outlet.
Figure 5A:
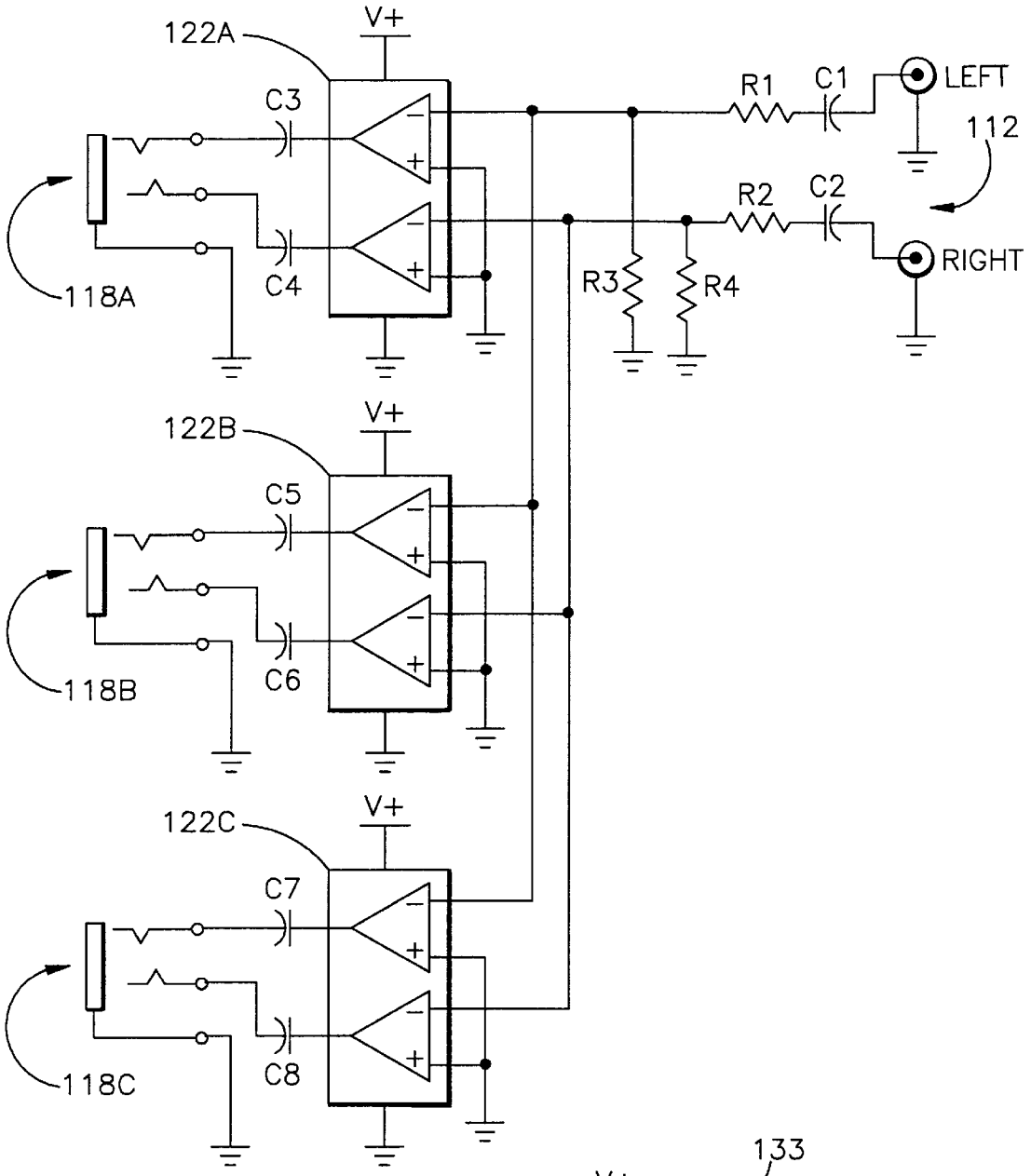
FIG. 5A is a schematic diagram of a second, and more preferred, embodiment of a circuit for practicing this invention.
Figure 5B:
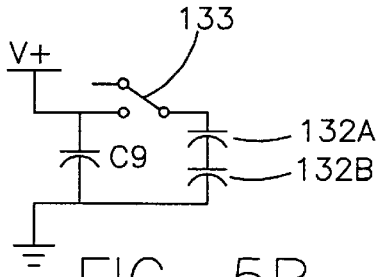
FIG. 5B is a schematic diagram of the low-voltage power supply for the circuit illustrated in FIG. 5A.

Referring now to FIGS. 4, 5A and 5B, a second and preferred embodiment of this invention includes a modified housing 116 having a bottom 116*a* and a top 116*b*. A curved battery cover 116*c* retains the batteries in the housing in conventional fashion.

An elongated circuit board, containing the circuits shown in FIGS. 5A and 5B, is sandwiched between the bottom 116*a* and top 116*b* of housing 116. This circuit board, conveniently, will have one of its elongated edges in abutment or near-abutment with top 116*b* and the other with bottom 116*a*. This orientation permits the headphone jacks 118*a*, 118*b* and 118*c* to be affixed directly to the flat surface of the board with the ports exposed through the plastic cover 116*b* in the manner illustrated. An on-off switch 119 is accessible from the surface of housing 116. Cable 114 is connected to the primary signal source (portable sound system 20 illustrated in FIG. 1) by means of a suitable jack such as that identified by the reference numeral 12 in FIG. 2.

The amplifier circuit, illustrated schematically in FIG. 5A, includes three independent two-channel linear amplifiers 122*a*, 122*b* and 122*c*. These are low-voltage amplifiers (three volts or thereabouts) and, preferably, are surface mounted. The Phillips IC BTDA 7050TD is a suitable amplifier.

The right and left channels of the incoming signal from the primary receiver 20 are fed to the inputs of integrated circuits 122*a*, 122*b* and 122*c* in the manner illustrated in FIG. 5A. The ICs individually perform the separation process, isolating the common input audio signal and then amplifying it. After the isolation/amplification process, the signal, which is now a low-impedance audio output, is routed through suitable conductors to the associated headphone jack 118*a*, 118*b* or 118*c*. Each listener, thus, will receive an output at his or her headphone that is independent from the other's (with the exception that the input signal is common).

It has been found that individual headphone volume for the embodiment illustrated in FIGS. 4, 5A and 5B can be effectively controlled by the primary source 20 volume control, eliminating the necessity for an individual volume control or controls in the headphone jack extended outlet. Such controls may be provided, of course, if desired.

FIG. 5B illustrates schematically the power supply which is self-contained within the housing 116. It includes two AA batteries 132A and 132B and an on-off switch 133. The batteries, as already noted, can ride within the housing 116 beneath the cover plate 116C, suitable terminals being provided to electrically contact the battery terminals.

The housing mode in the configuration illustrated in FIG. 4 is approximately 4½ inches in length, 1-inch thick and 1-inch deep. The batteries, which power the amplifiers, can be placed end-to-end beneath the cover plate 116C. The result is an extremely compact, self-powered and self-contained unit capable of receiving a stereo input and creating therefrom three relatively independent stereo outputs, each capable of powering a separate set of headphones or speakers.

Value choices for the resistors and capacitors shown in the circuits of FIGS. 5A and 5B can be readily chosen by those skilled in the art. Merely by way of example, it has been found that elements having the following values provide satisfactory results:

$R_1$—1K ohms $R_2$—1K ohms $R_3$—100 ohms $R_4$—100 ohms $C_1$–$C_9$ 100 $\mu$F The amplifier, so constructed, has a frequency response equal to or exceeding 20 to 20,000 Hz±2 Db. (EIAJ CP-307 method). The output of each of the jacks 118 into 16 ohm headphones will be approximately 40 mW per channel. Signal quality equals that at the single source 20.

Figure 6:
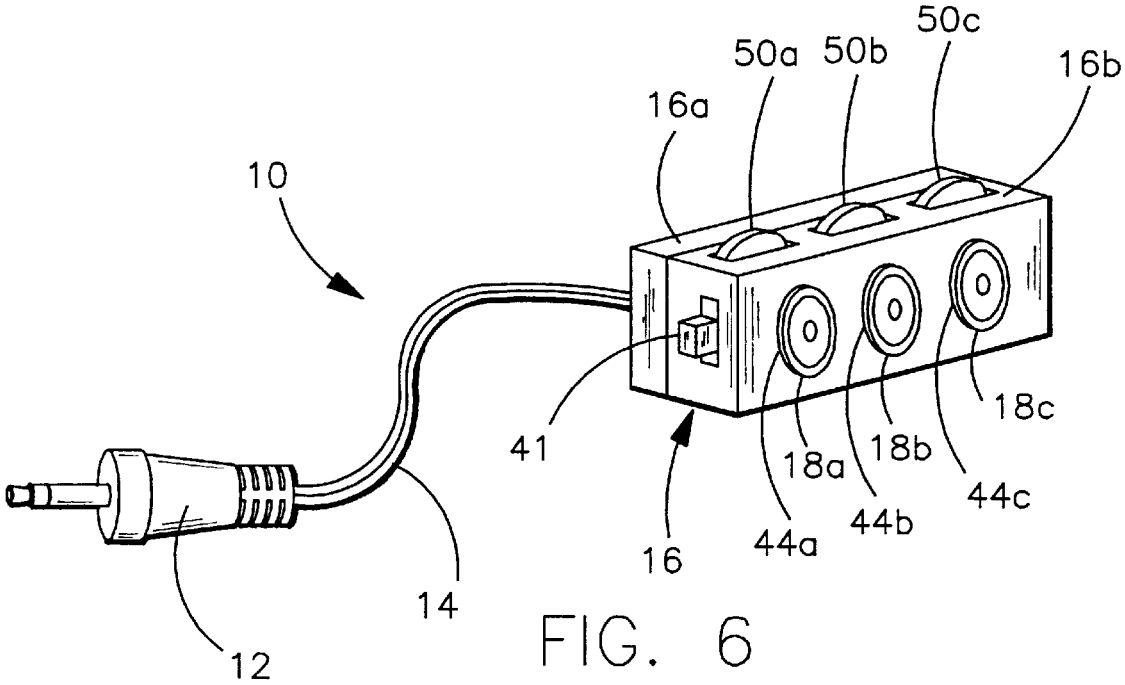
FIG. 6 is a perspective view of an alternative headphone jack extended outlet enabling individual volume control at each lack.

FIG. 6 shows an alternative embodiment of the present invention in which the circuit 20 is modified to allow distinct volume control for each headphone jack outlet 18*a–c*. In this embodiment, a potentiometer (not shown) is wired in series with each of the headphone jacks 18*a–c*. The control knob 50*a–c* for each potentiometer extends through an opening in the housing 14 so that it is easily accessible to a user. This and a variety of other techniques and methods for providing volume control will be readily apparent to those of ordinary skill in the art.

The above descriptions are those of preferred embodiments of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A headphone jack extended outlet for powering multiple headphone jacks from a single two-channel source, said outlet comprising:

a housing, said housing containing a two-channel amplifier having an input and output and a power supply for said amplifier;

input means accessible from the exterior of said housing for receiving a two-channel output signal from said single two-channel source, said input means interconnecting said output signal with the amplifier input;

a plurality of two-channel headphone jacks having plug-receiving apertures, said jacks being positioned within said housing so as to have the plug-receiving apertures accessible from the exterior of said housing; and means interconnecting each of said jacks with said amplifier output.

2. The outlet as set forth in claim I which further comprises a two-channel amplifier for each of said headphone jacks whereby the output at each of said jacks is independent of the output of the other.

3. The outlet as set forth in claim 2 wherein said amplifiers are low-voltage amplifiers.

4. The outlet as set forth in claim 2 wherein said power supply comprises a battery carried within said housing, said housing including a battery cover which can be opened to gain access to said battery.

5. The outlet as set forth in claim 1, wherein said input means is a headphone plug.

6. The outlet as set forth in claim 1, wherein said input means receives an electrical two-channel output signal and applies said electrical signal directly to said amplifier input.

7. An audio device for delivering an audio signal originating from a single two-channel audio source to a plurality of headphones, said audio device comprising:

a housing having a plurality of externally accessible headphone jacks for receiving an equal number of headphone plugs associated with the plurality of headphones;

a headphone plug external to said housing for coupling to a headphone jack of the audio source to receive a two-channel audio signal from the audio source;

a plurality of two-channel amplifiers equal in number to the number of said headphone jacks, said amplifiers being contained within said housing and having outputs connected to said headphone jacks and inputs commonly coupled to said headphone plug to receive therefrom the audio signal from the audio source; and power supply means contained within said housing for providing power to said amplifiers.

8. The audio device as defined in claim 7, wherein said power supply means comprises at least one battery contained within said housing.

9. The audio device as defined in claim 7 and further including a volume control mechanism externally accessible from said housing for controlling the volume of the audio signal output from said amplifiers.

10. The audio device as defined in claim 7 and further including separate volume control mechanisms externally accessible from said housing for independently controlling the volume of the audio signals output from each of said amplifiers.

11. The audio device as defined in claim 7, wherein said power supply means delivers power to said amplifiers that is received from an external power source.

12. The audio device as defined in claim 11, wherein the external power source is a source of AC power.

13. A portable headphone jack extension unit comprising:

a housing;

a headphone plug connected to said housing;

a plurality of headphone jacks mounted within said housing;

a circuit electrically interconnecting said headphone plug and said headphone jacks to deliver signals received through said plug to said jacks, said circuit including amplifiers to amplify the signals, one of said amplifiers being provided for each of said jacks, whereby the output of each said jack is independent from that of the other jacks; and power means within said housing for providing electrical power to said amplifiers, whereby said unit permits a plurality of headphones to be operated from a single headphone jack on an audio system.

* * * * *